United States Patent [19]

Abernethy et al.

[11] 4,202,593

[45] May 13, 1980

[54] JACK

[75] Inventors: Lynn W. Abernethy, Advance; Elvert S. Watts, Walkertown, both of N.C.

[73] Assignee: AMP Incorporated, Harrisburg, Pa.

[21] Appl. No.: 31,791

[22] Filed: Apr. 20, 1979

[51] Int. Cl.[2] ..... H01R 13/54; H01R 13/64

[52] U.S. Cl. ..... 339/125 R; 339/176 M; 339/184 R

[58] Field of Search ..... 339/91 R, 17 C, 17 LC, 339/193 P, 196, 125 R, 206, 207, 208, 176 M, 92 M, 99 R, 126 R, 19, 176 MP, 205, 184

[56] References Cited

U.S. PATENT DOCUMENTS

| | | | |
|---|---|---|---|
| T958,009 | 5/1977 | Snyder | 339/99 R |
| T961,003 | 8/1977 | Krumreich | 339/176 M |
| 3,850,497 | 11/1974 | Krumreich | 339/126 R |

*Primary Examiner*—Joseph H. McGlynn
*Assistant Examiner*—John S. Brown
*Attorney, Agent, or Firm*—Gerald K. Kita

[57] ABSTRACT

A telephone jack is disclosed for modular telephone connection. The jack includes an anvil constructed to receive a tool for inserting press fit contacts of the jack into a printed circuit board. A housing containing the contacts is secured to the board with expansible sleeves. Expansion plugs for the sleeves are carried by the housing.

6 Claims, 13 Drawing Figures

Fig. 4
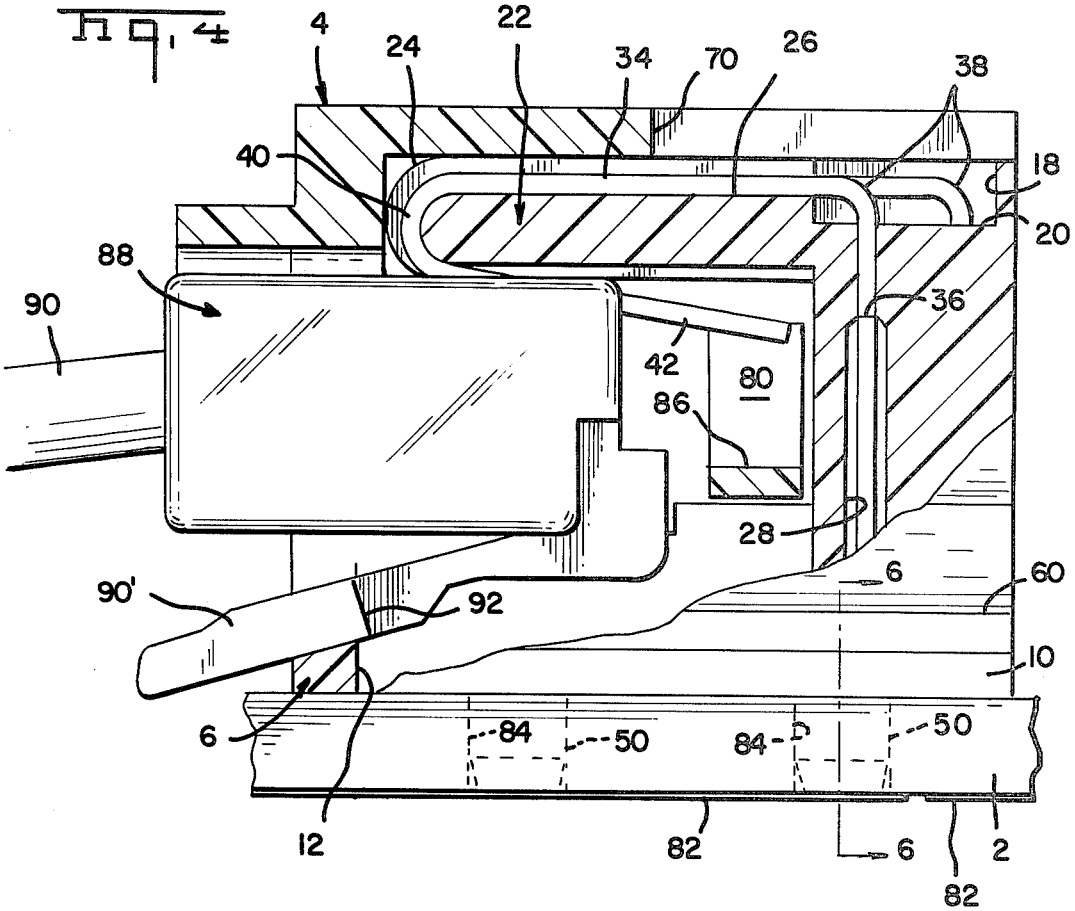
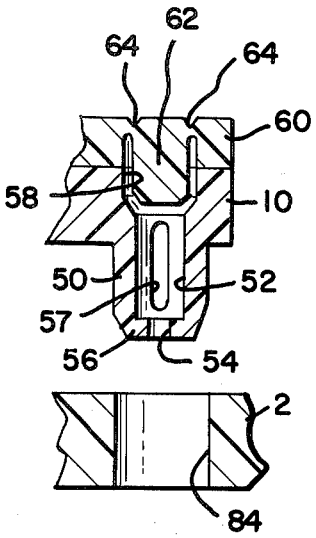
Fig. 5
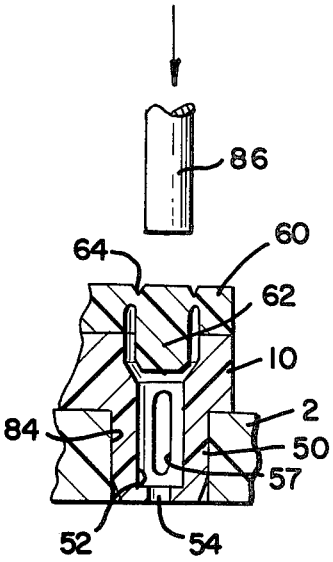
Fig. 6
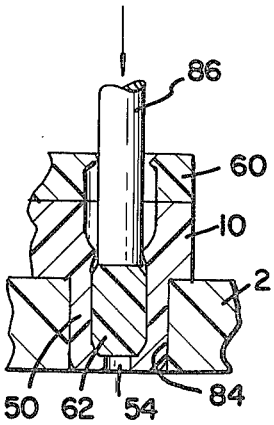
Fig. 7

JACK

FIELD OF THE INVENTION

The present invention relates to improvements in a standard jack for a national telephone network.

BACKGROUND OF THE INVENTION

A jack is disclosed in U.S. Pat. No. 3,850,497 in which a plurality of spring contacts project into a plug receiving cavity. Each contact is spliced by a compression sleeve connection to a corresponding insulated wire.

SUMMARY OF THE INVENTION

A jack according to the present invention includes resilient beam contacts protruding from a base for wedged connection in a circuit board. The base is provided with an anvil which receives a ram type tool for driving the contacts into a circuit board. The base includes expansible sleeves for insertion into apertures of a circuit board. The cover is secured to the base and is provided with expansion plugs in alignment with the sleeves. The plugs are connected to the cover and are constructed for separation from the cover and for forcible insertion into the sleeves, forcing the sleeves to expand tightly against the walls of the circuit board apertures. The base includes an interior platform having grooves in which the contacts are supported. A comb structure integral with the cover supports free ends of the contacts within a plug receiving cavity. A window opening in the cover provides access to the comb structure to allow for molding of the same integral with the cover. The window opening additionally provides access to the anvil surface. The contacts are constructed to resist dislodgement during insertion into a circuit board.

OBJECTS

An object of the present invention is to provide an improved jack having an anvil surface for a ram type tool for forcibly inserting terminals of the jack into a circuit board, the terminals being constructed to prevent dislodgement during the insertion opertion.

Another object of the present invention is to provide a jack for telephone interconnection having electrical terminals for wedged connection in a circuit board, together with expansible sleeves for mounting a housing of the jack on a circuit board.

Another object of the present invention is to provide a telephone jack having electrical contacts mounted in a two piece housing provided with expansible sleeves and separately connected wedges in alignment with the sleeves and constructed for wedged insertion within the sleeves to expand the same.

Other objects and advantages of the present invention will become apparent from the following detailed description taken in conjunction with the drawings.

DRAWINGS

FIG. 4 is an enlarged elevation in section similar to FIG. 2 and illustrating connection of the jack contacts with a plug connector.

FIGS. 5, 6, & 7 are fragmentary enlarged sections diagramatically illustrating an expansible sleeve connection of the jack to a circuit board.

Figure 8:
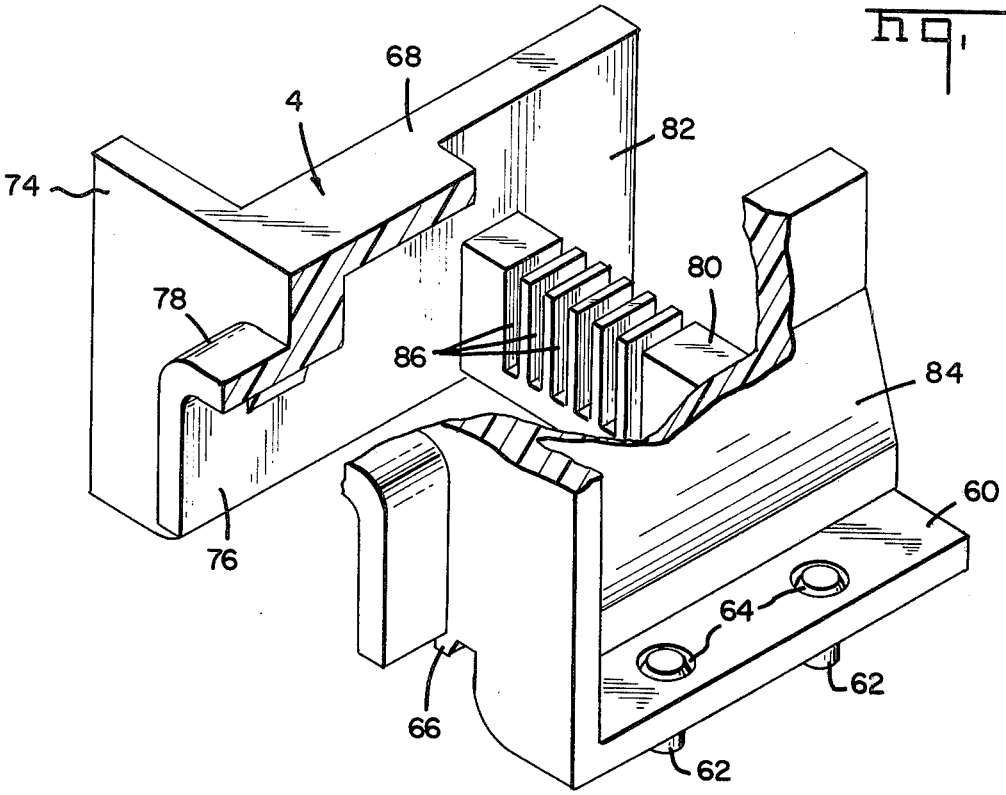

FIG. 8 is an enlarged perspective of a cover portion of the jack with parts broken away to illustrate a shelf with a comb structure.

Figure 9:
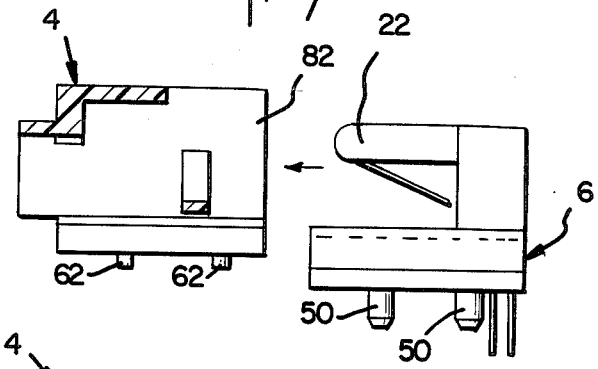
Figure 10:
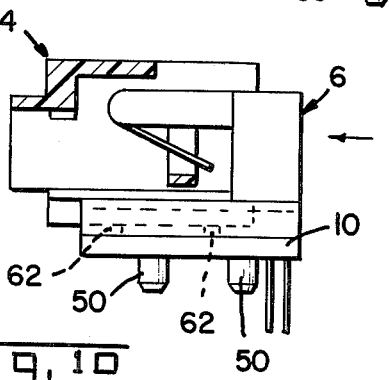
Figure 11:
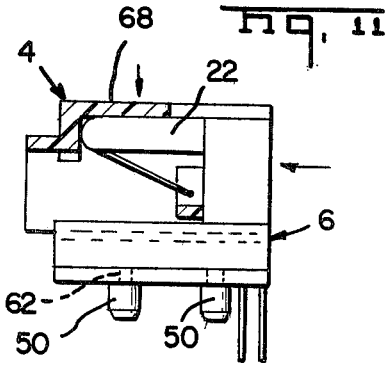

FIGS. 9, 10, & 11 are diagramatic views illustrating assembly of the cover to a base of the jack according to the invention.

Figure 2:
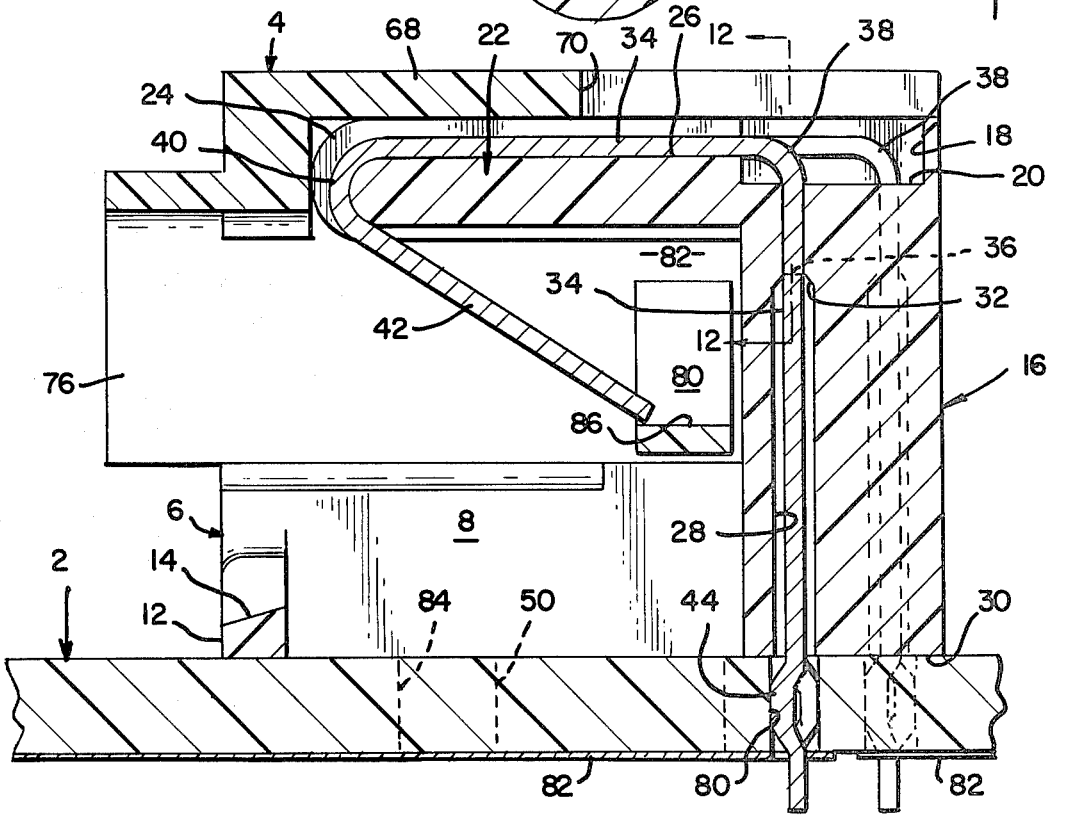
FIG. 2 is an enlarged elevation in section along the line 2—2 of FIG. 1.
Figure 12:
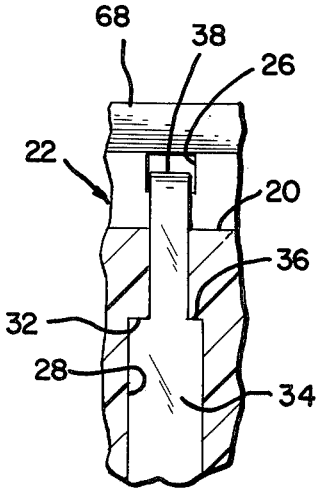

FIG. 12 is an enlarged fragmentary section along the line 12—12 of FIG. 2.

Figure 1:
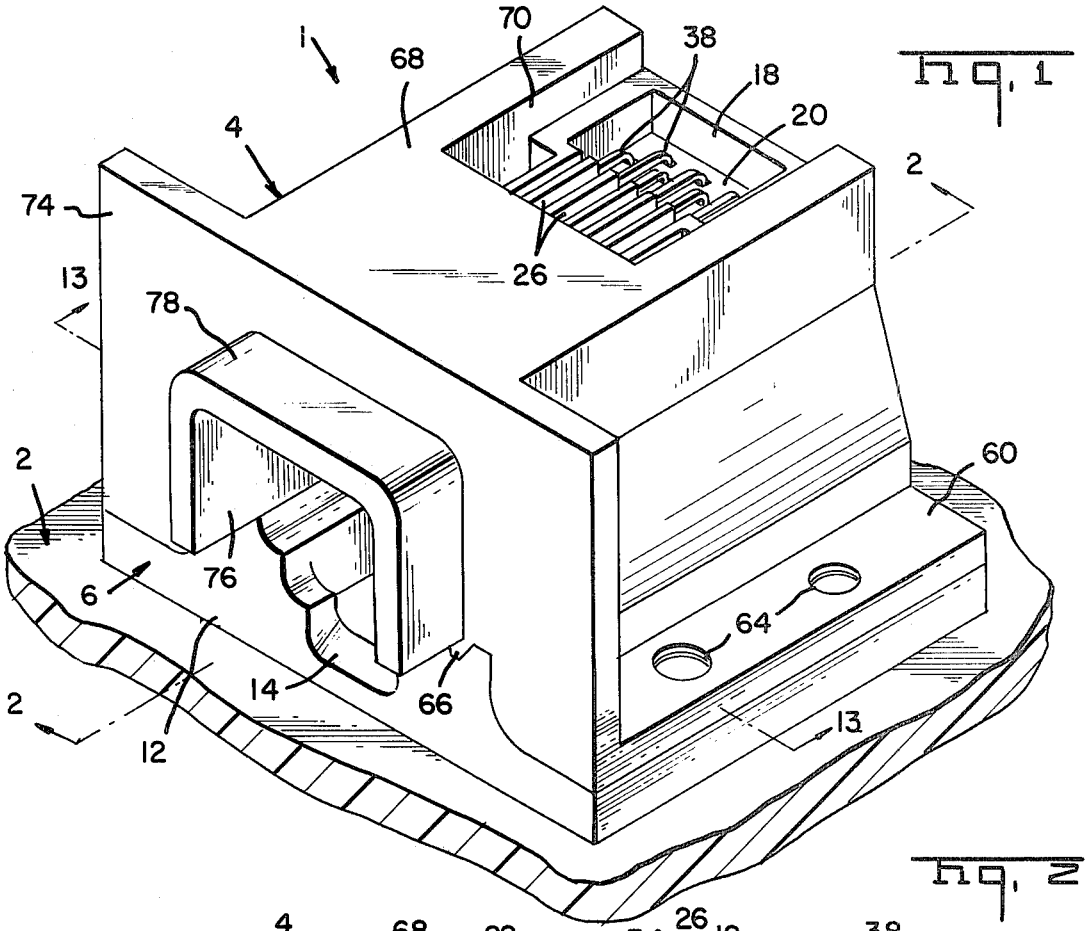
FIG. 1 is an enlarged fragmentary perspective of a modular jack according to the present invention.
Figure 13:
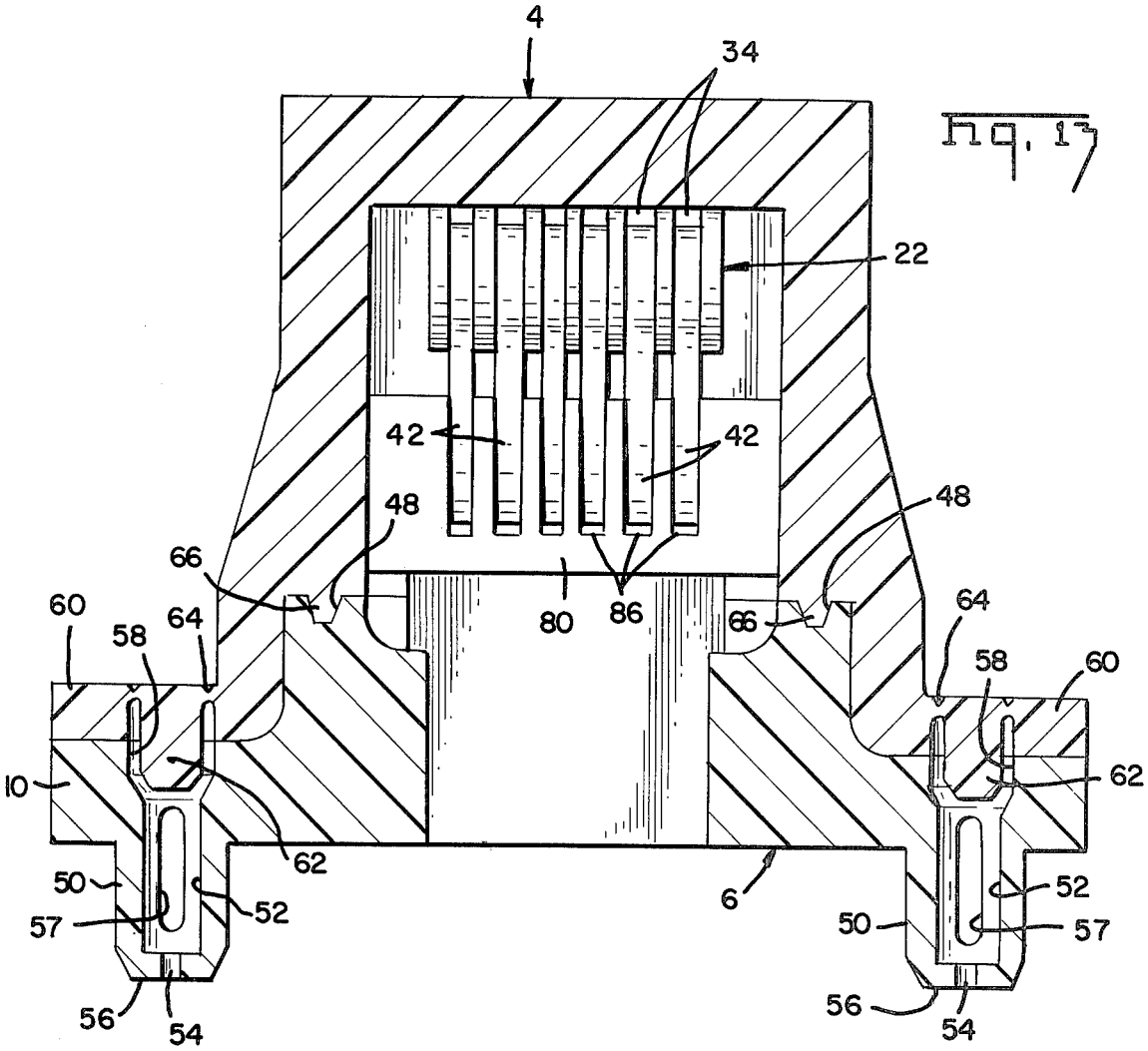

FIG. 13 is an elevation in section of the embodiment shown in FIG. 1.

DETAILED DESCRIPTION

Figure 3:
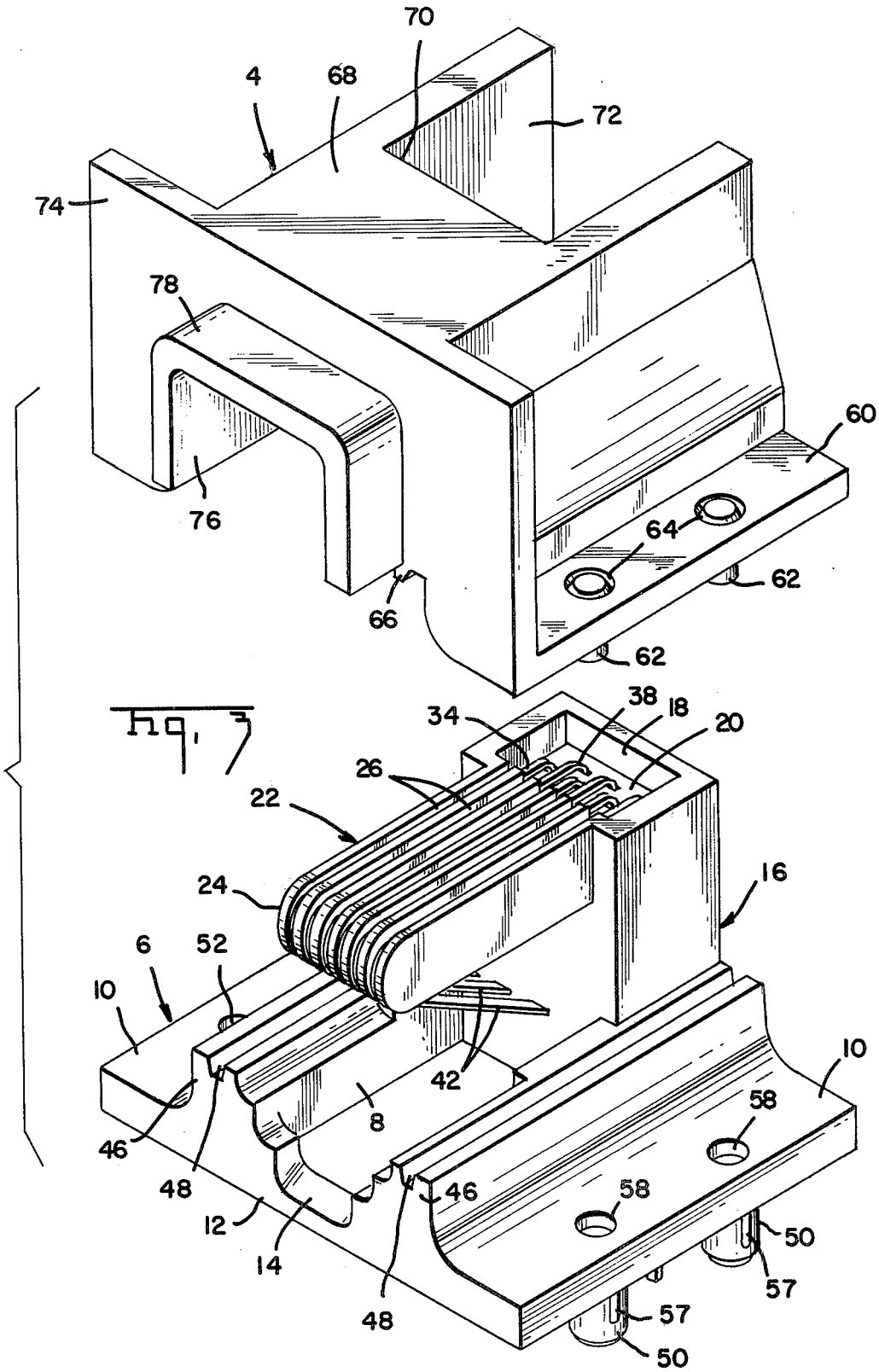
FIG. 3 is an enlarged perspective with parts exploded of the jack illustrated in FIG. 1.

With more particular reference to the drawings, there is illustrated generally at 1 in FIG. 1 a modular jack adapted for mounting to a printed circuit board, a portion of which is illustrated at 2. As shown in FIG. 3, the jack includes a two piece housing, a cover portion 4, and a base portion 6, each of unitary construction and molded from a suitable dielectric material. The base is provided with a central opening 8 through a bottom wall 10. The opening 8 is defined at one end by a side wall 12 of the base having an opening 14 therethrough communicating with the opening 8. The opening 14 is of stepped pyramid profile to conform with the profile of a plug type electrical connector, as will be explained. An opposite end of the opening 8 is defined by a rectangular pillar 16 projecting vertically from the bottom wall 10. The top of the pillar 16 is provided with a rectangular recess 18 having a bottom wall 20 serving as an anvil for a ram type tool to be received in the recess 18 for a purpose to be described. The pillar 16 further includes an integral platform 22 generally parallel with the bottom wall 10, with a clearance separating the platform 22 and the bottom wall 10. The platform 22 is in vertical alignment with the opening 8 and is provided with a radiused end 24. As shown in FIGS. 2 and 3 the platform is provided with a plurality of parallel grooves 26 in the top planar surface of the platform and in the rounded end 24. The grooves 26 communicate with the recess 18.

As shown in FIGS. 2 and 12, the pillar 16 is provided with a plurality of vertically extending cavities 28 communicating with a bottom 30 of the pillar and perpendicularly through the bottom wall 20 of the recess 18. Each cavity has a stepped cross section, that is, a relatively large cross section for a portion of its length extending from the pillar bottom 30, and a reduced cross section for a portion of its length extending from the bottom wall 20. An inverted shoulder 32 is provided for the reduced cross section intersects the enlarged cross section. Each cavity 28 receives an elongated resilient metal terminal or contact 34 which is inserted into the cavity 28, first, through the bottom 30 until emerging perpendicularly through the bottom wall 20. Each terminal 34 includes a shoulder 36 which seats against the inverted shoulder 32 to locate the terminal in proper position. Each terminal is then bent laterally of its length at a first bend 38 to follow along a corresponding groove 26 of the platform 22. Each terminal 34 is again bent with a second arcuate bend 40 to follow along the groove 26 in the arcuate end 24 of the platform 22. A free end 42 of each terminal projects diagonally from the end 24 into the clearance separating the platform 22 and the bottom wall 10. The other free end 44 of each terminal projects from the bottom 30 and is bifurcated into a pair of leg portions which are offset laterally from each other to provide a relatively widened combined cross section for a purpose to be described.

As shown in FIG. 3 the base 6 is provided with relatively thick elongated ribs 46 on either side of the profiled opening 14, and on either side of the opening 8. Each thick rib 46 is provided with a narrow longitudinal groove 48. The bottom wall 10 is provided further with a plurality of integral depending sleeves 50, the details of which are illustrated more particularly in FIGS. 13 and 5. Each sleeve has a cylindrical recess 52 terminating at an end wall 56 having a core pin hole 54 with small slots 57 in the cylindrical sides. Each recess 52 communicates with an enlarged flared counterbore 58 in the top surface of the bottom wall 10.

FIGS. 3 and 13 illustrate the cover 4 having horizontal flanges 6 in which are molded depending cylindrical wedges or plugs 62 connected initially by frangeable webs 64 to the flanges 6. The cover 4 further is provided with integral thin ribs 66 which fit within the grooves 48 of the base 10. FIGS. 3 and 8 illustrate additional details of the cover 4. The cover has a top wall 68 provided with a rectangular opening 70 which opens along one side into an open end 72. The opposite end includes and integral wall 74 having a plug receiving opening 76 partially encircled by a bezel 78. FIG. 8 illustrates an integral shelf 80 bridging between spaced side walls 82 and 84 of the cover 4. The shelf 80 is provided with vertical, spaced slots 86. The opening is in alignment with the shelf and provides adequate clearance for molding the shelf.

FIGS. 9, 10, and 11 illustrate assembly of the cover 4 and base 6. FIG. 9 illustrates the platform 22 being introduced into the open end 82 of the cover. FIG. 10 illustrates sliding of the plugs 62 of the cover 4 along the bottom wall 10 of the base 6 until the plugs 62 register over the sleeves 50 of the base. FIG. 11 illustrates the cover 4 fully assembled on the base 6 when the plugs 62 enter the counterbores of the sleeves 50 and when the top wall 68 of the cover registers against the top of the platform 22, covering portions of the terminals 34 which are fully recessed in the grooves of the platform. The platform covers the shelf 80 which is in the clearance between the platform and the bottom wall 10. The contact ends 42 are captivated in the slots 82 of the shelf. The shelf thereby serves as a comb separating the contact ends 42. Thereafter, the assembly is ultrasonically welded together, with the thin ribs 66 of the cover, being of relatively low mass, absorbing most of the ultrasonic energy and fusing to the base 10.

The assembly is readily assembled to a circuit board 2, as described by reference to FIGS. 1 and 2. The tool receiving recess 18 is fully exposed through the window opening 70 to receive a ram type tool of any suitable type, with a direction of ram displacement vertically along the lengths of the terminals 34 and vertically along the pillar 16. The ram will press against anvil surface 20 to forceably insert the terminal ends 44 into corresponding apertures 80 of the circuit board 2. The offset leg portions of the terminals engage the sides of the apertures 80 and are forced to slide against and along each other to reduce their combined cross section sufficiently to enter the apertures. The leg portions additionally will frictionally engage each other to limit their sliding along each other, so that the legs frictionally wedge against each other and tightly against the sides of the aperture 80. The terminal ends 44 also will frictionally engage plated circuit paths 82 of the circuit board 2. Alternatively, they may be soldered to the paths 82.

FIGS. 5, 6, and 7 illustrate additional assembly steps wherein the sleeves 50 enter apertures 84 in the circuit board 2. Thereafter, a cylindrical ram type tool illustrated at 86 will engage each plug 62, fracturing the thin web 64 of each plug and forcing the plug into the hollow interior 52 of a corresponding sleeve 50. Each plug 62 is slightly oversized in respect to the inner diameter of the sleeve 50 such that the plug 62 will radially expand the sleeve 50 into tight engagement with the sides of the apertures 84.

FIG. 4 illustrates an electrical connector plug 88 secured to a multiple conductor cable 90. The plug is of the type described in U.S. Pat. 3,850,497 having a profile commensurate with the cooperating openings 76 and 14. The plug is received in the space or clearance between the platform and the bottom wall 10. A resilient lever 90 of the plug has a shoulder 92 which registers in latched engagement against the interior of the wall 12. Electrical contacts, not shown, on the plug engage corresponding ends 42 of the terminals 34, deflecting the same to assure frictional and electrical contact therewith. The free ends 42 remain confined and separated from one another in the grooves 86 of the shelf 80.

Although a preferred embodiment of the present invention is disclosed, other embodiments and modifications which would be apparent to one having ordinary skill in the art are intended to be covered by the spirit and scope of the appended claims.

What is claimed is:

1. In a jack having a housing containing a plurality of resilient contacts communicating with a cavity of the housing into which an electrical jack is plugged to connect electrically with the contacts, the improvement comprising:

said housing including a base portion providing an interior platform having grooves in which lengths of said contacts are supportred, free ends of said contacts projecting into a space between said platform and a bottom wall of said base, said contacts having terminal portions projecting from said bottom wall together with expansible sleeves integral with said bottom wall, a cover secured to said base having a jack receiving opening communicating with said space.

2. The structure as recited in claim 1, wherein, said cover includes an integral shelf for supporting and separating said contact free ends.

3. The structure as recited in claim 1, wherein, said platform is connected by a pillar to said bottom wall, said terminal portions are in alignment with said pillar, and said pillar has an anvil surface perpendicular to the axes of said terminal portions.

4. The structure as recited in claim 3, wherein, said cover includes an opening in alignment with said anvil surface and with said shelf, and said platform projects across said opening to overlie said shelf.

5. The structure as recited in claim 1, wherein, said base includes a wall having a profiled opening conforming to the profile of a jack to be received in said jack receiving opening.

6. The structure as recited in claim 1, wherein said cover includes plugs in alignment with said sleeves, said plugs being oversized with respect to the interiors of said sleeves so that upon separation of said plugs from said cover and insertion into said sleeves, said sleeves are expanded.

* * * * *